US010478023B2

(12) United States Patent
Osborne, Jr.

(10) Patent No.: US 10,478,023 B2
(45) Date of Patent: Nov. 19, 2019

(54) FOLDED TOWEL DISPENSER WITH OVERFILL PREVENTION

(75) Inventor: Charles Agnew Osborne, Jr., Cumming, GA (US)

(73) Assignee: Solaris Paper, Inc., Alpharetta, GA (US)

( * ) Notice: Subject to any disclaimer, the term of this patent is extended or adjusted under 35 U.S.C. 154(b) by 27 days.

(21) Appl. No.: 13/883,235

(22) PCT Filed: Nov. 3, 2011

(86) PCT No.: PCT/US2011/059210

§ 371 (c)(1),
(2), (4) Date: Jul. 16, 2013

(87) PCT Pub. No.: WO2012/061634

PCT Pub. Date: May 10, 2012

(65) Prior Publication Data

US 2013/0284757 A1 Oct. 31, 2013

Related U.S. Application Data

(60) Provisional application No. 61/409,632, filed on Nov. 3, 2010.

(51) Int. Cl.
*A47K 10/42* (2006.01)
*B65H 1/00* (2006.01)

(52) U.S. Cl.
CPC ..... *A47K 10/424* (2013.01); *B65H 1/00* (2013.01)

(58) Field of Classification Search
USPC ..... 221/33, 45, 63
See application file for complete search history.

(56) References Cited

U.S. PATENT DOCUMENTS 340,355 A * 4/1886 Ramser ..... 221/59
1,622,597 A * 3/1927 Mangold ..... A47F 1/085 221/62
1,689,571 A * 10/1928 West ..... A47K 10/422 221/45
2,081,564 A * 5/1937 Tuszynski ..... A47K 10/424 221/55
2,143,614 A * 1/1939 Winter et al. ..... 221/53
(Continued)

OTHER PUBLICATIONS

Patent Cooperation Treaty, "International Search Report and Written Opinion", PCT Application No. PCT/US1159210, dated Mar. 16, 2012.

*Primary Examiner* — Gene O Crawford
*Assistant Examiner* — Kelvin L Randall, Jr.
(74) *Attorney, Agent, or Firm* — Fish IP Law, LLP

(57) ABSTRACT

Apparatus, systems, and methods in which a sheet product dispenser comprises a front cover moveably coupled with a housing back, and an overfill prevention protrusion disposed in an internal storage space defined by the front cover and housing back. The interior storage space is configured to hold a plurality of stacked sheets. The front cover and/or the housing back includes an opening for dispensing the plurality of sheets. The overfill prevention protrusion is configured to gradually interfere with the plurality of stacked sheets from fitting in the interior storage space. For example, the protrusion may be configured to prevent the plurality of stacked sheet from stacking in a linear fashion (e.g., in a fashion parallel to a wall of the housing back).

19 Claims, 3 Drawing Sheets

(56) References Cited

U.S. PATENT DOCUMENTS 3,134,503 A 5/1964 Jones et al.
3,589,555 A * 6/1971 Burkhalter, Jr. ..... 221/35
3,809,287 A * 5/1974 Muller-Scherak ..... A47F 1/08 221/66
4,938,382 A * 7/1990 Frazier ..... A47K 10/424 211/16
5,509,571 A * 4/1996 Weber ..... 221/46
5,642,836 A * 7/1997 Merriweather, Jr. ..... 221/62
5,884,805 A * 3/1999 Tramontina ..... A47K 10/424 221/282
5,957,324 A * 9/1999 Gettelman et al. ..... 221/55
6,708,841 B2 * 3/2004 Baughman ..... A61B 42/40 221/155
6,920,999 B2 * 7/2005 Taylor ..... A47K 10/424 221/154
7,021,493 B2 * 4/2006 Brickwood ..... A47F 1/04 206/39.6
7,048,143 B2 * 5/2006 Sanders et al. ..... 221/46
7,374,065 B2 * 5/2008 Taylor ..... A47K 10/424 221/279
7,845,515 B2 * 12/2010 Moody ..... A47K 10/424 221/36
8,851,326 B2 * 10/2014 Tramontina ..... A47K 10/424 221/279
2001/0020624 A1 * 9/2001 Hubanks et al. ..... 221/45
2003/0080137 A1 * 5/2003 Clark et al. ..... 221/34
2003/0116580 A1 * 6/2003 Baughman ..... A61B 42/40 221/45
2004/0084470 A1 * 5/2004 Taylor ..... A47K 10/424 221/52
2004/0084471 A1 * 5/2004 Taylor ..... A47K 10/424 221/61
2007/0119858 A1 * 5/2007 Ayoub ..... 221/2
2008/0113855 A1 * 5/2008 Gooding, Jr. ..... 493/127
2011/0266301 A1 * 11/2011 Fodor ..... A47K 10/424 221/154
2013/0092701 A1 * 4/2013 Tramontina ..... A47K 10/424 221/45

* cited by examiner

FIG. 1
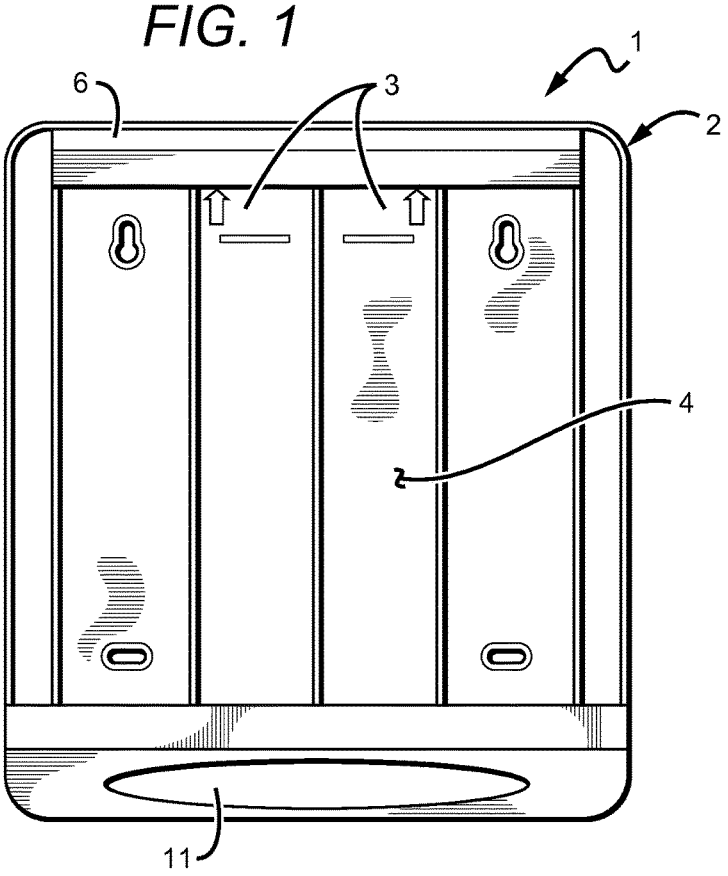
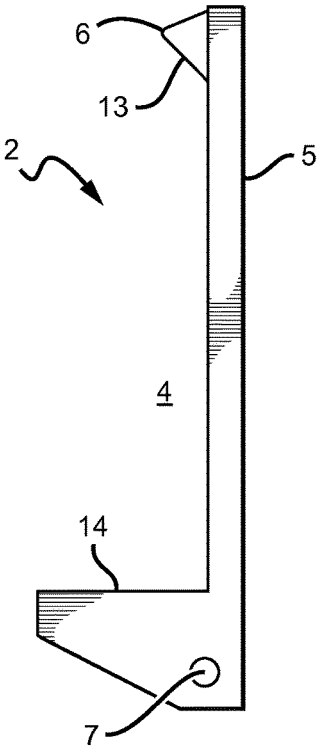
FIG. 2
FIG. 3
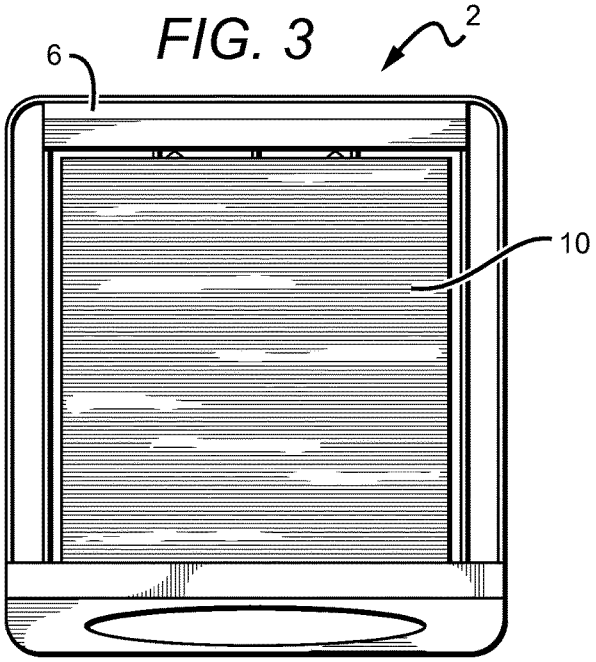

FIG. 4
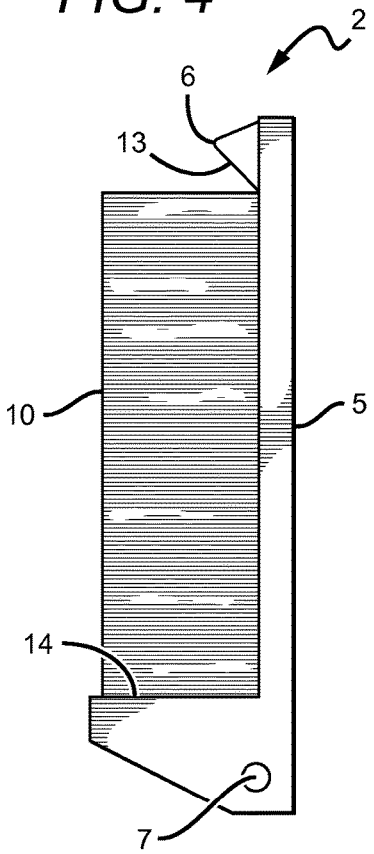
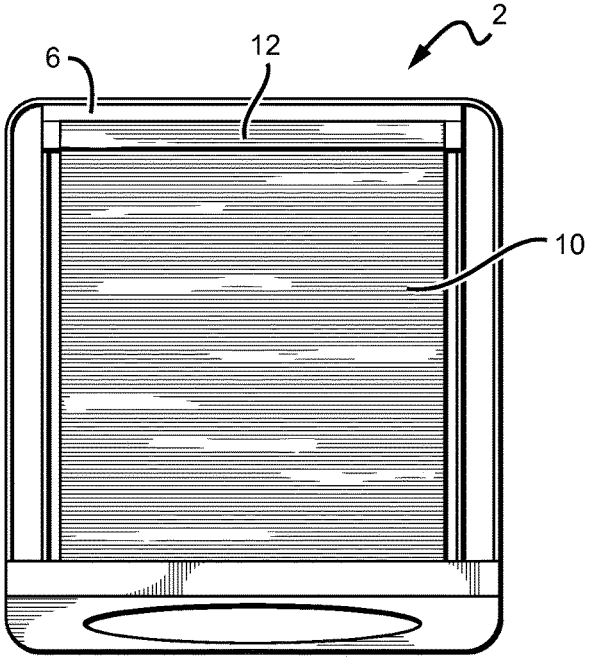
FIG. 5
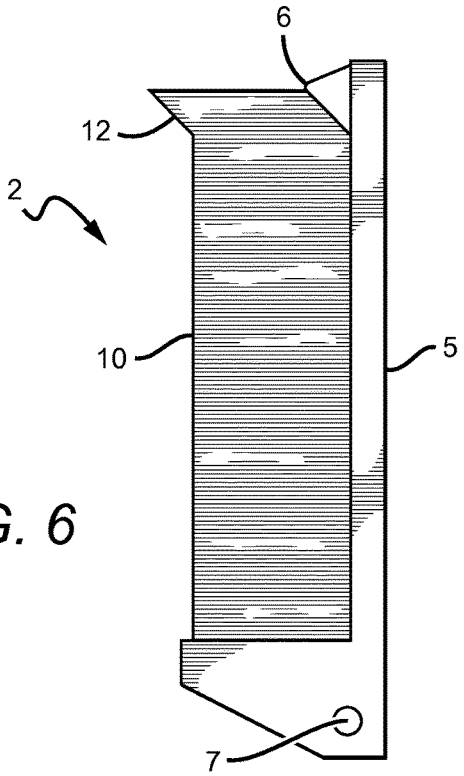
FIG. 6

FIG. 7
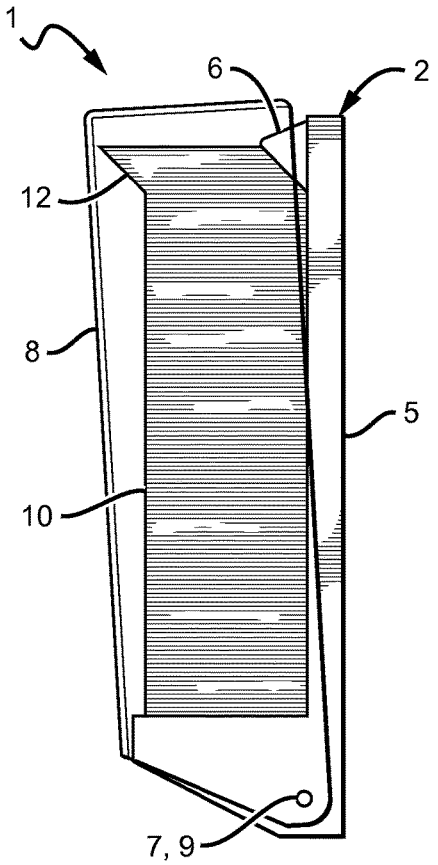
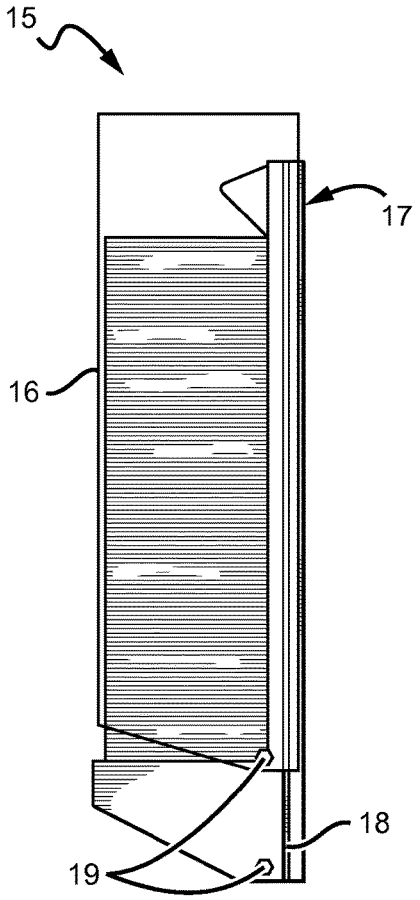
FIG. 8

FOLDED TOWEL DISPENSER WITH OVERFILL PREVENTION

This application claims the benefit of priority to U.S. provisional patent application Ser. No. 61/409,632, filed on Nov. 3, 2010.

FIELD OF THE INVENTION

The field of the invention is dispensers, more specifically, overfill prevention for sheet product dispensers.

BACKGROUND

When a technician fills a paper towel dispenser there is a tendency to overfill the dispenser with as much paper product as possible, in order to reduce the number of times the dispenser needs to be serviced. However, if too much product is added, the stack of paper towels will have a buildup of pressure. This increased pressure makes dispensing difficult and increases the likelihood of tabbing or ripping the paper towels.

Numerous sheet product dispensers have been designed with overfill prevention mechanisms. U.S. Pat. No. 5,884,805 to Tramontina, for example, describes an overfill feature that will prevent the dispenser's cover from being closed if too much product is loaded into the dispenser. Tramontina specifically describes an overfill bracket that will be displaced from its normal position, thus preventing the front cover from engaging with the housing back. Since the front cover cannot close when the dispenser is overfilled with sheet product, the dispenser technician will need to remove enough product to allow the overfill bracket to move back to its normal position and allow the cover to engage with the closure mechanism.

This and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

Another overfill prevention mechanism is described in U.S. Pat. No. 6,520,372 to Phelps. Phelps describes a moveable housing bottom that lifts up as the dispenser cover is opened, thus reducing the internal storage space that can accept folded product. When the cover is closed, the bottom drops down increasing the internal storage space which in return prevents the overfilling of the folded product. U.S. Pat. No. 374,065 to Taylor also describes an overfill prevention feature that limites available storage capacity when the front cover is open, and increases storage capacity when the front cover is closed.

In addition, U.S. Pat. No. 6,920,999 to Taylor describes an overfill mechanism that requires the technician to use two hands. This prevents the technician from pushing down and compressing (e.g., stuffing) the stack of folded product into the dispenser in order to add extra sheet product, thus preventing overfilling.

Unfortunately, the prior art requires complex linkages and/or moving parts. It has yet to be appreciated that an overfill prevention feature can comprise a simple single non-moving part.

Thus, there is still a need for improved overfill prevention features for sheet product dispensers.

SUMMARY OF THE INVENTION

The inventive subject matter provides apparatus, systems, and methods in which a sheet product dispenser comprises a front cover moveably coupled with a housing back, and an overfill prevention protrusion disposed in an internal storage space defined by the front cover and housing back. The interior storage space is configured to hold a plurality of stacked sheets. The front cover and/or the housing back includes an opening for dispensing the plurality of sheets. The overfill prevention protrusion is configured to gradually interfere with the plurality of stacked sheets from fitting in the interior storage space. For example, the protrusion may be configured to prevent the plurality of stacked sheets from stacking in a linear fashion (e.g., in a fashion parallel to a wall of the housing back).

The dispenser preferably includes a stacking surface for stacking the plurality of sheets. In addition, the overfill prevention protrusion preferably includes a first surface disposed in a plane that intersects a plane defined by the stacking surface. In some embodiments, the angle of intersection is at least 15 degrees, more preferably at least 30 degrees, most preferably at least 45 degrees.

Unless the context dictates the contrary, all ranges set forth herein should be interpreted as being inclusive of their endpoints, and open-ended ranges should be interpreted to include commercially practical values. Similarly, all lists of values should be considered as inclusive of intermediate values unless the context indicates the contrary.

In other aspects of some preferred embodiments, the overfill prevention protrusion preferably extends into the interior storage space at a length of at least 20% of a width of the stacking surface, more preferably at least 30%, most preferably at least 50%.

In yet other aspects of some preferred embodiments, the front cover and housing back are rotatably coupled. However, translating couplings are also contemplated. The dispenser preferably includes a latching mechanism for locking the front cover and housing back together, thus controlling access to the internal storage space.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWING

FIG. 1 is a front view of one embodiment of a dispenser, without sheet product in the internal storage space.

FIG. 2 is a side view of the housing back of the dispenser of FIG. 1.

FIG. 3 is a front view of the housing back of the dispenser of FIG. 1 with sheet product disposed in the internal storage space.

FIG. 4 is a side view of the housing back of the dispenser of FIG. 1 with sheet product disposed in the internal storage space.

FIG. 5 is a front view of the housing back of the dispenser of FIG. 1 with sheet product disposed in the internal storage space beyond the overfill prevention protrusion.

FIG. 6 is a side view of the housing back of the dispenser of FIG. 1 with sheet product disposed in the internal storage space beyond the overfill prevention protrusion.

FIG. 7 is a side view of the dispenser of FIG. 1 with the front cover partly closed due to interference of the stacked sheet product with the front cover.

FIG. 8 is a side view of another embodiment of a dispenser.

DETAILED DESCRIPTION

One should appreciate that the disclosed techniques provide many advantageous technical effects including a simple non-moving solution for preventing overfilling of sheet product dispensers.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

FIG. 1 shows a front view of a towel dispenser assembly 1. Dispenser 1 comprises a housing back 2 and a front cover 8 (see FIG. 7). Front cover 8 is moveable between an open position for accessing cavity 4 (for loading sheet product), and a closed position (for storing and dispensing the sheet product). In FIG. 1, front cover 8 has been removed and sheet product 10 (FIGS. 3 and 4) has not yet been placed in cavity 4. FIG. 1 also shows fill level indicator 3 and an overfill protrusion 6. Indicator 3 shows an appropriate level for filling cavity 4 with sheet product 10. Overfill protrusion 6 prevents closure of front cover 8 when sheet product 10 has been filled beyond indicator 3. Dispenser 1 also has an opening 11 for dispensing sheet product, which could alternatively be located on front cover 8 rather than housing back 2.

FIG. 2 shows a side view of dispenser 1, without front cover 8 or sheet product 10. Housing back 2 has a stacking surface 14 for stacking sheet product 10 and an overfill protrusion 6 for preventing cavity 4 from being overfilled. Protrusion 6 extends from housing back 2 into cavity 4 and has a first surface 13 that is angled with respect to stacking surface 14. Vertical wall 5 can include fasteners for fastening dispenser 1 to a surface such as a wall. Pivot coupling 7 is used to rotatably couple front cover 8 to housing back 2.

The angle between first surface 13 and stacking surface 14 is preferably at least 15 degrees, more preferably 30 degrees, most preferable at least 45 degrees. If the angle is too small, a technician may be able to stuff a stack of sheet product between surfaces 13 and 14, causing undesirable pressure in the stack of sheet product.

The width that protrusion 13 extends into cavity 4 is preferably at least 15% of the width of surface 14, more preferably at least 25%, most preferably at least 50%. If the width of protrusion 13 is too small, overfill position 12 will not be large enough to interfere with front cover 8 from closing.

While FIGS. 1 and 2 show surface 13 as a substantially flat surface, those of skill in the art will appreciate that non-planar surfaces could also be used consistently with the inventive subject matter disclosed herein. For example, surface 13 could be concave or convex. In addition, while FIGS. 1 and 2 show stacking surface 14 on housing back 2, surface 14 could alternatively be included in front cover 8.

FIG. 3 shows a front view of a dispenser 1, with sheet product 10 disposed in cavity 4 of housing back 2, just below overfill protrusion 6. FIG. 3 shows an acceptable amount of sheet product 10 loaded in dispenser 1. FIG. 4 shows a side view of dispenser 1 with an acceptable amount of sheet product 10 loaded in cavity 4. Sheet product 10 rests on stacking surface 14 and rises to just below first surface 13 of overfill protrusion 6. Sheet product 10 stacks parallel with vertical wall 5.

FIG. 5 shows a front view of dispenser 1 with sheet product 10 overfilling cavity 4 (e.g., beyond level indicator 3 and protrusion 6). Protrusion 6 causes sheet product 10 to interference with front cover 8 from coupling with housing back 2, as best seen in FIG. 6.

FIG. 6 shows a side view of dispenser 1 with sheet product 10 extending into overfill position 12. When a technician overfills cavity 4 by compressing the stack of sheet product, the stack will expand upward as the technician removes pressure from the stack. As the stack expands upward, it travels along vertical wall 5 until it hits surface 13, forcing the stack forward into overfill position 12. This, in turn, prevents front cover 8 from closing. The technician is prompted to remove sheet product until front cover 8 can close properly.

FIG. 7 shows a side view of towel dispenser assembly 1 with sheet product 10 overfilling cavity 4. Protrusion 12 interferes with the closure of front cover 8, alerting the dispenser technician that sheet product must be removed. The technician is prevented from overfilling cavity 4, thus preventing any pressure buildup within the stack of sheet product 10.

The inventive concepts disclosed herein are specifically contemplated for use with rectangular folded paper towels. However, one of skill in the art will recognize that these inventive concepts can be equally applicable with non-rectangular, non-folded, non-absorbent, and/or non-paper sheets of product. As such, the inventive subject matter is not intended to be limited by the term "sheet product." The advantage of the present invention is a simple overfill prevention feature that does not require the movement of additional parts, which can be applied to numerous kinds of sheet dispensers.

FIG. 8 shows a dispenser assembly 15, which has a front cover 16 translatably coupled with housing back 17. Housing back 17 has tracks 18 configured to engage with protrusions (not shown) on the inside of front cover 16, thus allowing front cover 16 to slide vertically with respect to housing back 17. When the interior cavity of dispenser 15 is overfilled with sheet product, front cover 16 is prevented from sliding down to enclose the sheet products. Once sheet product has been removed and the interior cavity is properly filled, front cover 16 slides down to couple with housing back 17. Latch mechanism 19 interlocks front cover 16 with housing back 17 and controls who may access the cavity of dispenser 15.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A dispenser for dispensing a preset amount of stacked sheets, comprising:

a front cover moveably coupled with a housing back, wherein the front cover and housing back define an interior storage space for storing the preset amount of stacked sheets, wherein the front cover is configured to move between an open position and a closed position, wherein the front cover and the housing back are pivotably coupled at a hinge, wherein moving between the open position and the closed position comprises the front cover pivoting at the hinge, wherein front cover has two opposing sides that at least partially overlap with two opposing sides of the housing back to define an overlapping area when the front cover is in the closed position, wherein the hinge is disposed in the overlapping area, wherein a top surface of the front cover covers a top surface of the housing back when the front cover is in the closed position, and wherein the top surface of the front cover extends from a front surface of the dispenser to a rear surface of the dispenser when the front cover is in the closed position;

at least one dispensing opening disposed on the housing back for dispensing at least one of the stacked sheets;

a stacking surface for stacking the preset amount of stacked sheets;

an overfill prevention protrusion fixedly disposed from the housing back and extending into the interior storage space, the overfill prevention protrusion having a bottom surface;

a wall disposed between the overfill prevention protrusion and the stacking surface, wherein the wall intersects with the stacking surface to form a first angle and the wall intersects with the bottom surface of the overfill prevention protrusion to form an obtuse angle; and wherein the overfill prevention protrusion remains at a fixed position and the bottom surface extends into the interior storage space in an amount sufficient to displace one or more stacked sheets exceeding the preset amount such that the one or more stacked sheets exceeding the preset amount physically obstruct the front cover from moving to the closed position.

2. The dispenser of claim 1, wherein the obtuse angle is greater than the first angle.

3. The dispenser of claim 1, wherein the overfill prevention protrusion extends into the interior storage space at a length of at least 25% of a width of the stacking surface.

4. The dispenser of claim 1, wherein the overfill prevention protrusion extends into the interior storage space at a length substantially equal to a width of the stacking surface.

5. The dispenser of claim 1, wherein the front cover and housing back are translatably coupled.

6. The dispenser of claim 1, wherein the wall is a vertical wall that extends from the stacking surface to a top end, and wherein the overfill prevention protrusion is disposed on the vertical wall below the top end.

7. The dispenser of claim 1, wherein the interior storage space is configured to hold the preset amount of stacked sheets against the wall and in a stack substantially parallel to the housing back.

8. The dispenser of claim 7, wherein the overfill prevention protrusion is configured to prevent stacked sheets exceeding the maximum stack size from stacking substantially parallel to the housing back.

9. The dispenser of claim 7, wherein the bottom surface slopes upward from the housing back at a point on the housing back corresponding to the maximum stack size.

10. The dispenser of claim 1, wherein the overfill prevention protrusion is configured such that the portion of the interior storage space between the overfill prevention protrusion and the front cover is insufficient to fit the cross-sectional area of the stack.

11. The dispenser of claim 1, wherein the bottom surface comprises a non-planar surface.

12. The dispenser of claim 1, wherein the at least one dispensing opening is disposed on a bottom surface of the housing back.

13. A dispenser for dispensing a preset amount of stacked sheets, comprising:

a front cover moveably coupled with a housing back that comprises a stacking surface, wherein the front cover and the housing back define an interior storage space for storing the preset amount of stacked sheets, wherein the front cover is configured to move between an open position and a closed position, wherein the front cover and the housing back are pivotably coupled at a hinge, wherein moving between the open position and the closed position comprises the front cover pivoting at the hinge, wherein front cover has opposite portions that at least partially overlap with the sides of the housing back to define an overlapping portion, wherein the hinge is disposed on the overlapping portion, and wherein a top surface of the front cover covers a top surface of the housing back when the front cover is in a closed position, and wherein the top surface of front cover extends from a front surface of the dispenser to a rear surface of the dispenser when the front cover is in the closed position;

at least one dispensing opening disposed on the housing back for dispensing the at least one of the preset amount of stacked sheets;

a non-moving overfill prevention protrusion disposed in the interior storage space, the non-moving overfill prevention protrusion including a first surface facing the stacking surface;

a wall disposed between the non-moving overfill prevention protrusion and the stacking surface; and wherein the first surface extends away from a fixed position on the wall and at an obtuse angle with respect to the wall in an amount sufficient to displace one or more stacked sheets exceeding the preset amount such that the one or more stacked sheets exceeding the preset amount physically obstruct the front cover from moving to the closed position.

14. The dispenser of claim 13, wherein the first surface comprises a non-planar surface.

15. The dispenser of claim 13, wherein the wall intersects (i) with the stacking surface at a first angle and (ii) with the first surface at a second angle that is different than the first angle.

16. The dispenser of claim 13, wherein the first surface extends from the wall at an angle of at least 15 degrees relative to the stacking surface.

17. The dispenser of claim 13, wherein the at least one dispensing opening is disposed on a bottom surface of the housing back.

18. A dispenser for dispensing a preset amount of stacked sheets, comprising:

a front cover moveably coupled with a housing back, wherein the front cover and the housing back define an interior storage space for the preset amount of stacked sheets, wherein the front cover and the housing back are pivotably coupled at a hinge, wherein moving between the open position and the closed position comprises the front cover pivoting at the hinge, wherein front cover has opposite portions that at least partially overlap with the sides of the housing back to define an overlapping portion, wherein the hinge is disposed on the overlapping portion, and wherein a top surface of the front cover covers a top surface of the housing back when the front cover is in a closed position, and wherein the top surface of front cover extends from a front surface of the dispenser to a rear surface of the dispenser when the front cover is in the closed position;

a horizontal stacking surface disposed in a bottom portion of the interior storage space;

at least one dispensing opening defined in the housing for dispensing at least one of the preset amount of stacked sheets;

an overfill prevention protrusion having a bottom surface extending from the housing back;

wherein the housing back comprises a vertical wall that intersects (i) with the horizontal stacking surface at a first angle and (ii) with the bottom surface of the overfill prevention protrusion at a second angle that is greater than the first angle; and wherein, during loading, the overfill prevention protrusion is configured to remain at a fixed position on the vertical wall while one or more stacked sheets that exceed the preset amount are displaced by the overfill prevention protrusion.

19. The dispenser of claim 18, wherein the at least one dispensing opening is disposed on a bottom surface of the housing back.

* * * * *